US006095877A

United States Patent [19]

Kawamukai et al.

[11] Patent Number: 6,095,877

[45] Date of Patent: Aug. 1, 2000

[54] OUTBOARD MOTOR

[75] Inventors: Kenji Kawamukai; Toshihiro Nozue; Kentaro Kameoka; Kazuyuki Kitajima, all of Shizuoka, Japan

[73] Assignee: Sanshin Kogyo Kabushiki Kaisha, Shizuoka-ken, Japan

[21] Appl. No.: 09/067,196

[22] Filed: Apr. 27, 1998

[30] Foreign Application Priority Data

Apr. 25, 1997 [JP] Japan ..... 9-109546
Jun. 10, 1997 [JP] Japan ..... 9-152168

[51] Int. Cl.[7] ..... B63H 21/10; B63H 20/32

[52] U.S. Cl. ..... 440/88; 440/900; 440/77

[58] Field of Search ..... 440/88, 49, 83, 440/900, 77, 76; 123/184, 21

[56] References Cited

U.S. PATENT DOCUMENTS

| | | | |
|---|---|---|---|
| 2,111,324 | 3/1938 | Linthwaite | 123/73 |
| 4,403,971 | 9/1983 | Kobayashi et al. | 440/88 |
| 4,522,602 | 6/1985 | Okazaki . | |
| 4,589,852 | 5/1986 | Price | 440/89 |
| 4,692,123 | 9/1987 | Tada et al. | 440/77 |
| 4,721,485 | 1/1988 | Suzuki . | |
| 4,723,927 | 2/1988 | Walsh et al. | 440/77 |
| 4,887,692 | 12/1989 | Outani et al. . | |
| 4,952,180 | 8/1990 | Watanabe et al. . | |
| 5,064,393 | 11/1991 | Inoue . | |
| 5,069,644 | 12/1991 | Kobayashi et al. . | |
| 5,078,629 | 1/1992 | Mondek | 440/88 |
| 5,181,871 | 1/1993 | Hiraoka et al. . | |
| 5,328,395 | 7/1994 | Oishi . | |
| 5,340,343 | 8/1994 | Kawamukai et al. | 440/88 |
| 5,489,227 | 2/1996 | Ishida et al. . | |
| 5,683,277 | 11/1997 | Tsunoda et al. | 440/88 |
| 5,899,778 | 5/1999 | Hiraoka et al. | 440/88 |

FOREIGN PATENT DOCUMENTS 60-38293 2/1985 Japan .

*Primary Examiner*—S. Joseph Morano
*Assistant Examiner*—Patrick Craig Muldoon
*Attorney, Agent, or Firm*—Knobbe, Martens, Olson & Bear, LLP

[57] ABSTRACT

An outboard motor includes an improved engine layout to provide a compact power head while simplifying the arrangement of components on the engine. In one mode, an induction system of the engine includes a carburetor that is arranged over a cylinder head. An intake pipe connects the carburetor to an intake port of the cylinder head. The pipe has generally a U-shape and loops around the upper side edge of the cylinder head. An air intake device is arranged upstream of the carburetor to supply air thereto. The air intake device includes a downward facing air intake opening that is located along a side of the engine below the upper end. This arrangement of the induction system that extends over the upper side of the engine produces a compact assembly without overly complicating the arrangement of other components on the engine, such as, for example, a manual starter device. With the present engine layout, the manual starter device is positioned on an upper side of the engine in front of the carburetor near a crankshaft of the engine. The air intake opening faces a lower air vent formed in a cowling below the engine. Cool air flows through the lower air vent and is drawn into the air intake opening for engine operation. This flow of cool air also cools the engine. The cowling also includes an upper vent to expel warm air from about the carburetor on the upper side of the cowling and to promote a current of air across the engine for cooling purposes.

38 Claims, 12 Drawing Sheets

OUTBOARD MOTOR

BACKGROUND OF THE INVENTION

1. Field of the Invention

The present invention relates to an outboard motor, and more particularly to an improved engine layout within a cowling of an outboard motor.

2. Description of Related Art

Outboard motors typically include a power head supported by an upper housing. A clamping bracket usually secures the upper housing to a transom of an associated watercraft. The upper housing also supports a lower unit that includes a propeller or similar propulsion device. An engine within a cowling of the power head drives the propeller via a drive train. The drive train commonly includes a drive shaft, which extends generally vertically through the upper housing, and a propeller shaft, which lies at about a 90 degree shaft angle with the drive shaft. A gear set couples the drive shaft to the propeller shaft. The propeller shaft extends in generally a horizontal direction and support the propeller at an aft end of the propeller shaft. Power from the engine is transferred from the drive shaft to the propeller shaft through the gear set to rotate the propeller.

In connection with portable outboard motors, the weight and drag associated with a portable outboard motor desirably is minimized in order to improve the performance of the outboard motor as well as to ease handling and transporting the outboard motor. Smaller size without sacrificing performance thus is desirable. As such, prior portable outboard motors have attempted to reduce the front-to-back dimension of the outboard motor's power head.

One prior approach involves an inclined cylinder arrangement within the cowling. That is, an axis of the cylinder is inclined or skewed (within a horizontal plane) relative to a longitudinal axis of the cowling. The cylinder axis remains normal to a vertical axis about which the drive shaft rotates, but lies to one side of the cowling's longitudinal axis. Japanese Patent Laid-Open No. 60-38293 discloses an example of this approach. An induction system, which includes a carburetor, is arranged on the side of the cylinder in the space freed within the cowling by the inclined cylinder arrangement. While this engine layout reduces the longitudinal dimension of the engine in an attempt to provide a compact engine design, the layout inhibits the arrangement of other engine components on the engine in a manner further reducing the engine's physical size.

SUMMARY OF THE INVENTION

A need therefore exists for an improved engine layout that minimizes the longitudinal dimension of the outboard motor power head while simplifying the arrangement of engine components within the cowling.

One aspect of the present invention involves an outboard motor comprising an engine that drives a propulsion device. The engine includes a cylinder block and a cylinder head that is attached to the cylinder block. A crankshaft is journalled to rotate within a crankcase formed on an opposite end of the cylinder block from the cylinder head. A starter device is coupled to the crankshaft and is positioned on an upper side of the engine, generally above the crankcase. An induction system includes a carburetor that is arranged generally above the cylinder head and to the side of the starter device. This layout of the above-noted engine components reduces the size of the outboard motor's power head while simplifying the arrangement of the components within the power head.

Another aspect of the present invention involves an outboard motor comprising an engine that drives a propulsion device. The engine includes a cylinder block and a cylinder head that is attached to the cylinder block. The cylinder block and the cylinder head together define at least one cylinder having an axis. An induction system comprises an air inlet and an outlet that communicates with the cylinder. The inlet is located on one side of the cylinder axis and the outlet is located on the opposite side of the cylinder axis. This arrangement again simplifies the layout of the engine while producing a compact engine design.

In accordance with an additional aspect of the present invention, an outboard motor comprises an engine which drives a propulsion device. The engine includes a cylinder block and a cylinder head that is attached to the cylinder block. The cylinder block and the cylinder head together define at least one cylinder having an axis. An induction system comprises at least one air inlet and at least one outlet. The outlet communicates with the cylinder. At least a section of the induction system crosses over a generally vertical plane that contains the axis of the cylinder.

Another aspect of the present invention involves the recognition that a cowling of the outboard motor desirably allows for the effective cooling of the engine, inhibits water invasion into an engine compartment formed within the cowling, affords an ample supply of atmospheric air for engine operations, and provides a compact arrangement of the engine and thus the outboard motor power head.

In one mode, a cowling includes at least first and second vents. The first vent is located generally above a charge former of an engine induction system that is arranged on an upper side of the engine. The second vent is located near a lower end of the cowling. Cool air is drawn into the cowling thought the second vent while warm air is expelled through the first vent. This air flow effectively cools the engine while providing an ample supply of atmospheric air for engine operation. The cowling also surrounds and substantially encloses the engine to inhibit an intake of water into the engine. The arrangement of the charge former above the engine also provides for a compact engine design, as mentioned above.

Further aspects, features and advantages of the present invention will now become apparent from detailed descriptions of several preferred embodiments which follow.

BRIEF DESCRIPTION OF THE DRAWINGS

The above-mentioned and other features of the invention will now be described with reference to the drawings of preferred embodiments of the present outboard motor. The illustrated embodiments are intended to illustrate, and not to limit the invention. The drawings contain the following figures.

DETAILED DESCRIPTION OF PREFERRED EMBODIMENTS OF THE INVENTION

Figure 1:
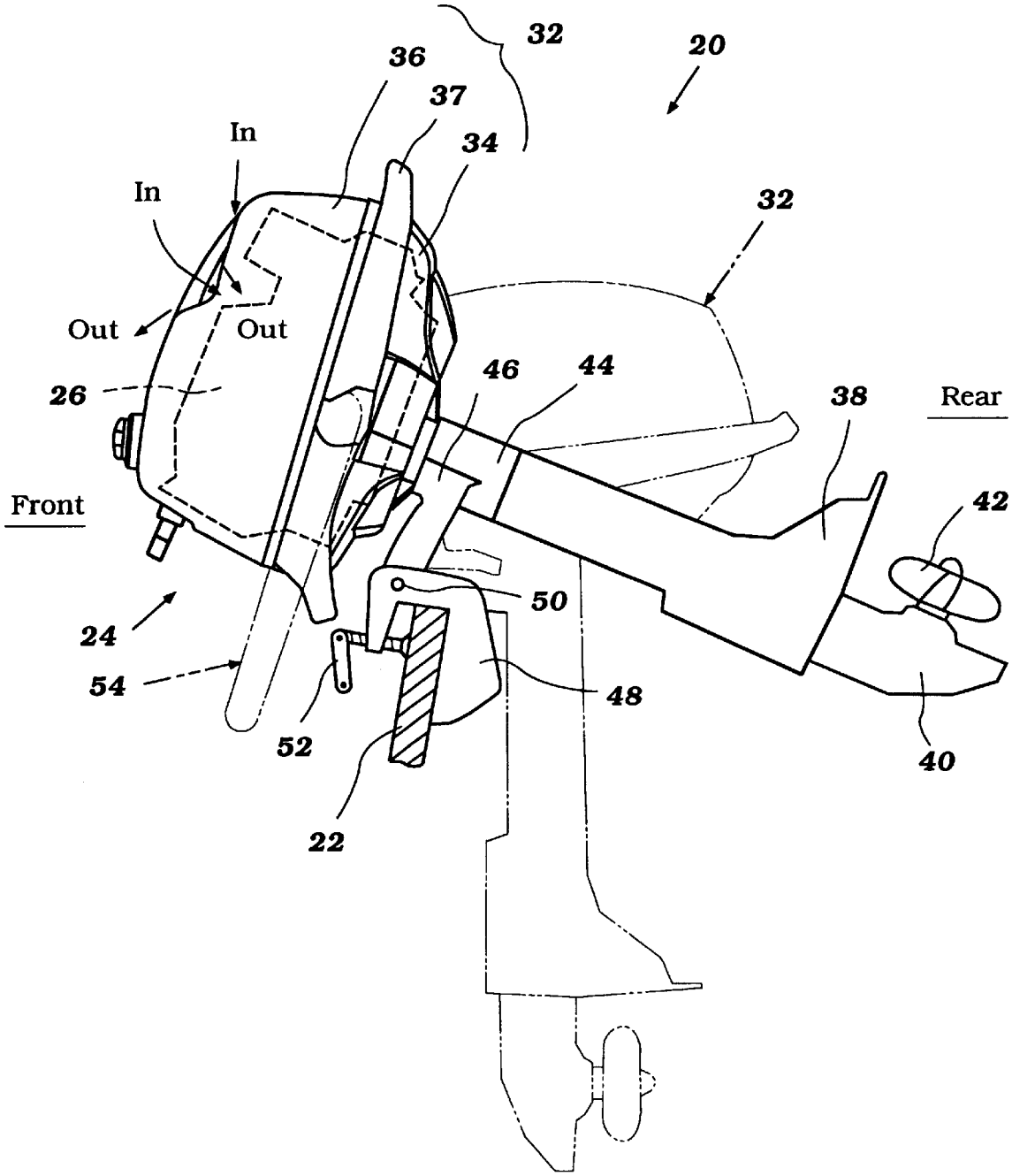
FIG. 1 is a side elevational view of an outboard motor configured in accordance with a preferred embodiment of the present invention.

FIG. 1 illustrates a marine outboard drive 20 which is configured in accordance with preferred embodiment of the present invention. In the illustrated embodiment, the outboard drive 20 is depicted as a portable outboard motor for mounting on a transom 22 at the stem of a watercraft. It is contemplated, however, that the present engine layout and cowling design can be incorporated with other types of outboard motors as well.

In order to facilitate the description of the present outboard motor 20, the terms "front" and "rear" are used to indicate positions of the outboard motor components relative to a fixed datum: the transom 22 of the watercraft. Thus, as used herein, "front" refers to a position or a side closer to the watercraft transom 22, and "rear" refers to a position or side distanced from the transom 22. Some of the figures included labels to further aid the reader's understanding.

With initial reference to FIG. 1, the outboard motor 20 has a power head 24 that includes an internal combustion engine 26. Because the present engine layout has particular utility with a four-cycle engine, the present invention will be described in connection with such an engine; however, the depiction of the present invention in conjunction with a four-cycle engine 26 is merely exemplary. The engine 26 also can also include either one, two or three cylinders when employed within the power head 24 of the portable outboard motor. Those skilled in the art, however, will readily appreciate that the present outboard motor can include engines having any number of cylinders, having any number of cylinder arrangements or orientations (e.g., V-type or slanted), and/or operating on other than a four-stroke principle.

As typical with the outboard motor practice, the engine 26 is supported within the power head 24 so that it's crankshaft 28 (FIG. 3) rotates about a generally vertical axis within a crankcase (not shown). The crankshaft 28 drives a drive shaft (not shown) which depends from the power head 24 and rotates about the generally vertical axis, as described below.

As seen in FIG. 1, a protective cowling assembly 32 surrounds the engine 26. The cowling assembly 32 includes a lower tray 34 and a top cowling 36. The tray 34 and cowling 36 together define a compartment which houses the engine 26 with the lower tray 34 encircling a lower portion of the engine 26. A carrying handle 37 is desirably coupled to the lower tray 34 so as to easily lift and transport the portable outboard motor 20.

A drive shaft housing 38 extends from the lower tray 34 and terminates in a lower unit 40. The drive shaft extends through the drive shaft housing 38 and is suitably journalled therein for rotation about the vertical axis.

The drive shaft continues into the lower unit 40 where it drives a propulsion device 42 though a gear set and a propulsion shaft (not shown). The lower unit 40 can also house a transmission that operates between the drive shaft and the propulsion shaft so as to establish forward, reverse and neutral drive conditions for the propulsion device 42.

The propulsion device 42 can take a variety of forms. In the illustrated embodiment, the propulsion device 42 is a single propeller having a plurality of propeller blades; however, it is understood that a counter-rotating, dual propeller propulsion device or a hydrodynamic jet can also be used.

A conventional steering shaft assembly is affixed to the drive shaft housing 38. The assembly includes a bracket 44 that encircles an upper end of the drive shaft housing 38 which is journalled to rotate within the bracket 44. Steering movement occurs about a generally vertical axis which extends through the bracket 44.

As seen in FIG. 1, an arm 46, which is connected to an upper end of the bracket 44, extends forward to support the drive shaft housing 38. The arm 46 in turn is pivotally connected to a clamping bracket 48 by a pin 50. A clamp handle 52 is tightened to attach the clamping bracket 48 to the transom 22 of the watercraft. This conventional coupling permits the bracket 44, and thus the outboard motor 20, to be pivoted relative to the clamping bracket 48 about the pin 50 to permit adjustment of the trim position of the outboard motor 20, and for tilt-up of the outboard motor 20.

Figure 3:
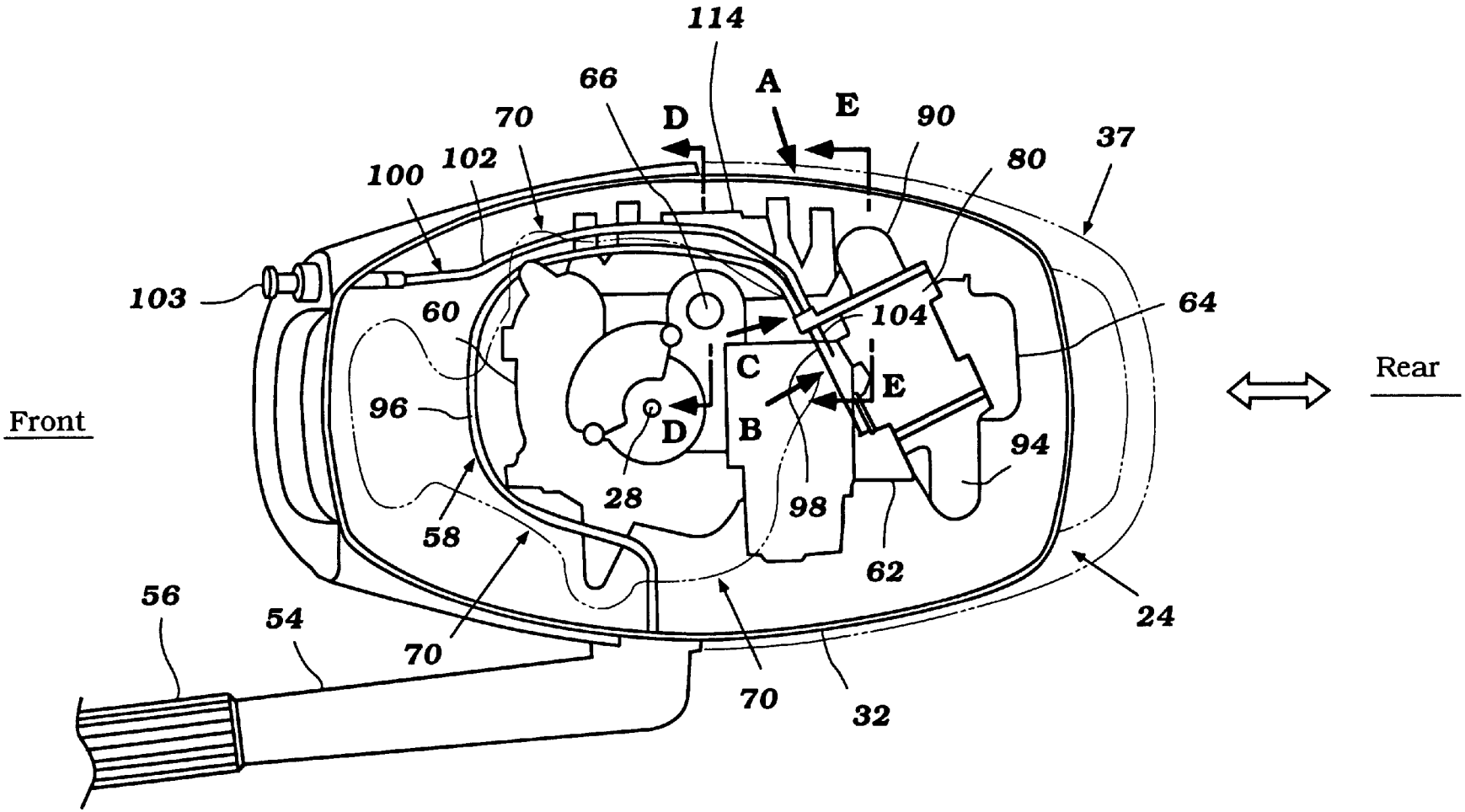
FIG. 3 is an partial sectional top view of the outboard motor of FIG. 1.

As seen in FIG. 1, a tiller control (not shown) and steering handle 54 are pivotally connected to the forward portion of the cowling lower tray 34. The pivotal arrangement of the steering handle 54 allows it to be located with any desired vertical orientation, as well as to be tilted up for storage. As best seen in FIG. 3, the steering handle 54 also includes a twist grip 56 at its forward end. The twist grip 56 typically actuates a disk (not shown) via a shaft (not shown). The shaft extends between the grip 56 and the disk which is located near the point of attachment between the handle 54 and the lower tray 34. The shaft is journalled for rotation within the housing of the steering handle 54. The disk is connected to the other end of the shaft and is provided with a circumferential groove that is adapted to accommodate the inner wire of at least one throttle control cable 58. The throttle cable 58 desirably is a bowden-wire that extends from the steering handle 54 into the cowling 32 of the outboard motor 20, in a conventional manner. The throttle control cable 58 is coupled to the engine 26 in the manner described below.

Figure 2:
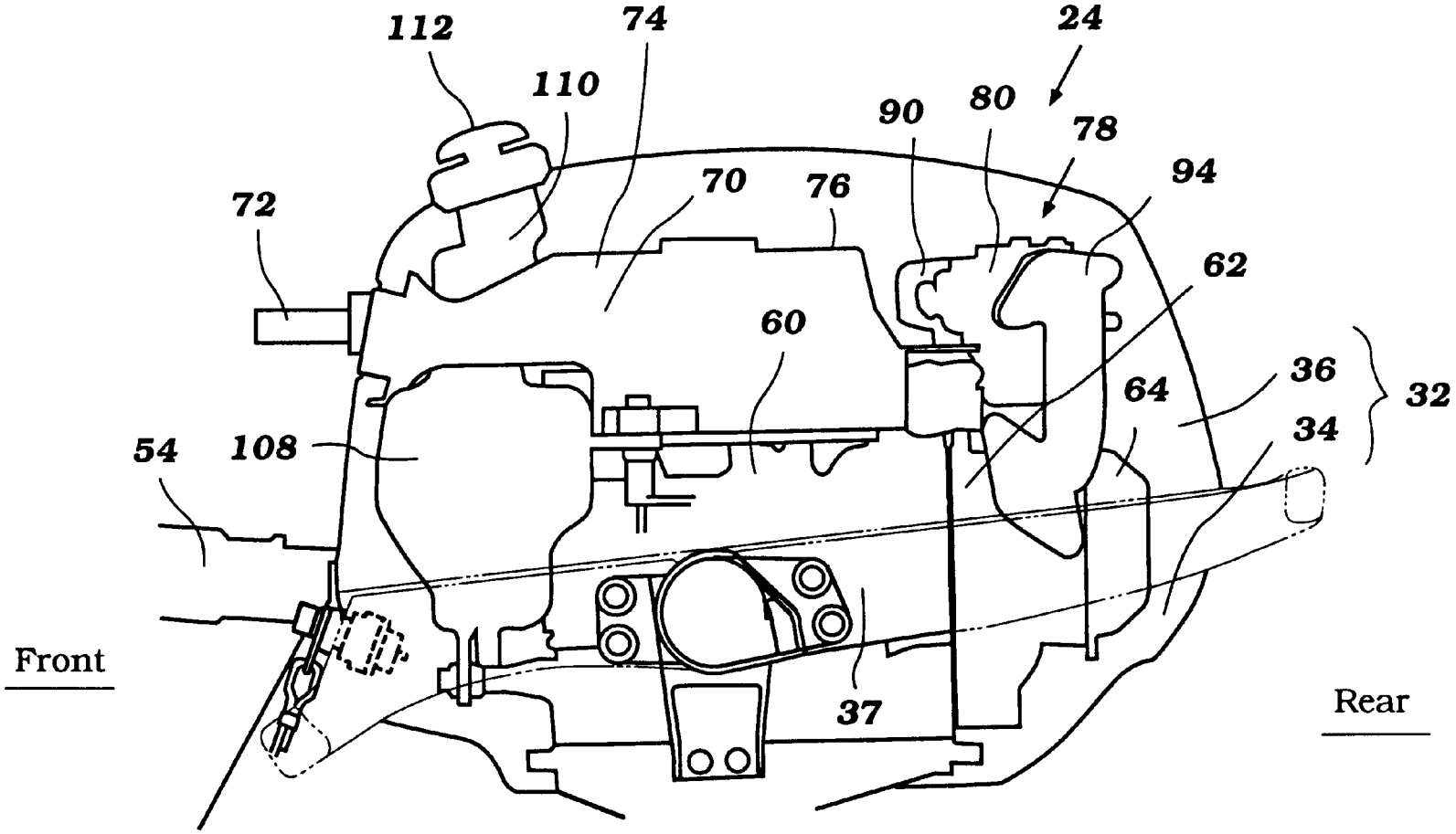
FIG. 2 is a partial sectional side view of the outboard motor of FIG. 1.
Figure 4:
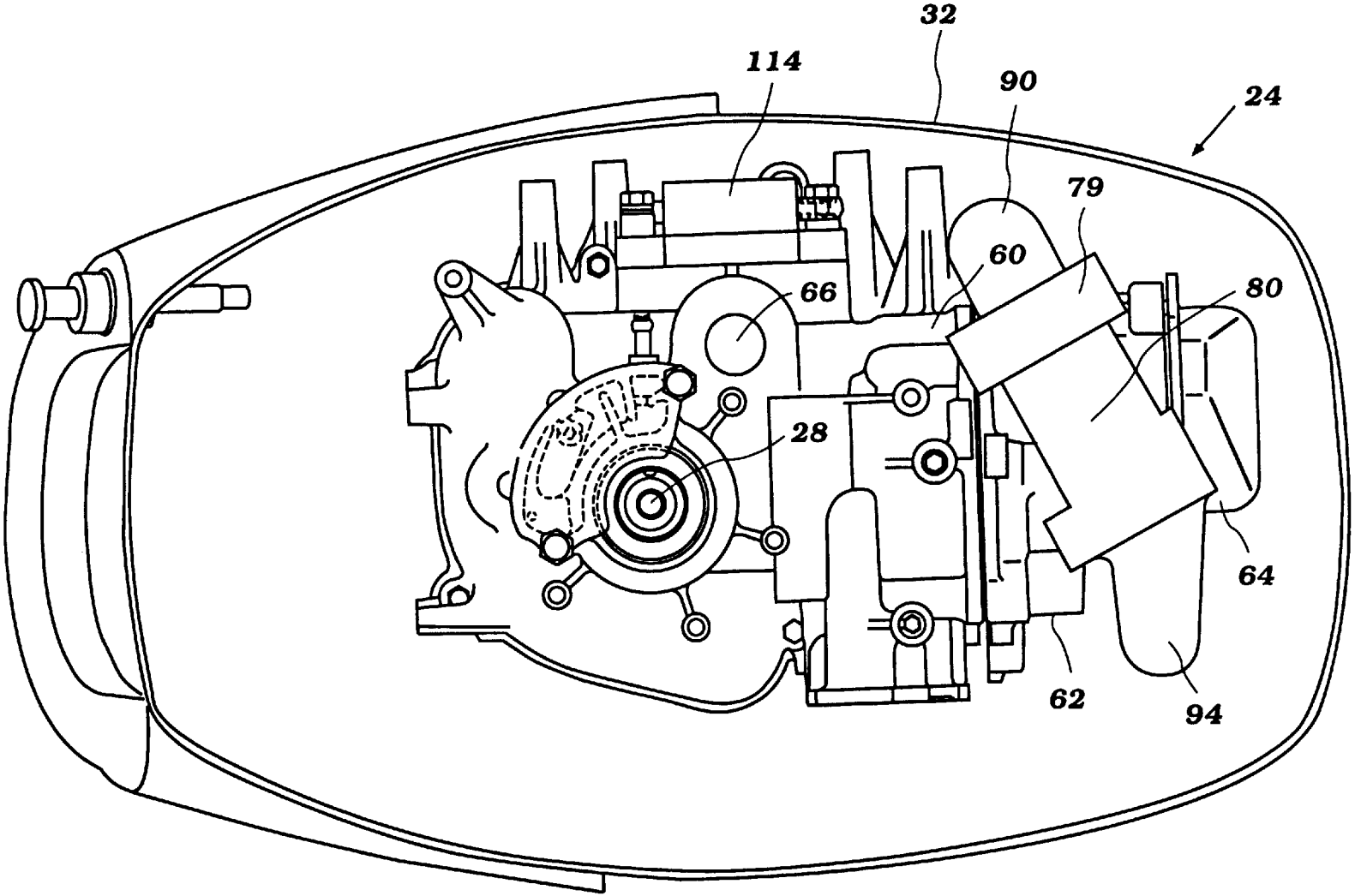
FIG. 4 is an enlarged partial sectional top view of the engine and a surrounding cowling of the present outboard motor.

With reference now to FIGS. 2 through 4, the engine 26 includes a cylinder block 60 having at least one cylinder bore (not shown) that has with its axis disposed in a horizontal direction. If the engine includes multiple cylinders, their axes desirably are vertically spaced one above the other in a conventional in-line cylinder configuration. The cylinder bore support a piston (not shown) that reciprocate with the bore and that is connected by connecting rods (not shown) to rotationally drive the crankshaft 28.

As has been previously noted, the crankshaft 28 rotates about a vertically extending axis. This crankshaft 28 is journalled within a crankcase chamber (not shown) formed by the cylinder block 60 and a crankcase member. The crankcase member (not shown) is affixed to one end of the cylinder block 60 in any known manner. It should be noted that the crankcase member lies near the front of the power head 24.

A cylinder head 62, is affixed to the opposite end of the cylinder block 60 and is formed with combustion chamber recesses (not shown), each of which cooperates with a respective one of the cylinder bores and a respective one of the pistons positioned within the corresponding cylinder bore. The recess, cylinder bore and piston together define one of the combustion chambers of the engine.

The cylinder head (62) is of a conventional construction. A cover 64 is attached to the cylinder head 62 on a side of the cylinder head 62 opposite the cylinder block 60. The cover 64 and the cylinder head 62 together define a chamber in which a conventional valve operation mechanism is journalled. In the illustrated embodiment, the engine 26 includes a plurality of rocker arms (not shown) that are supported by at least one rocker shaft (not shown). The rocker arms (not shown) operate intake and exhaust valves that the cylinder head supports.

Figure 8:
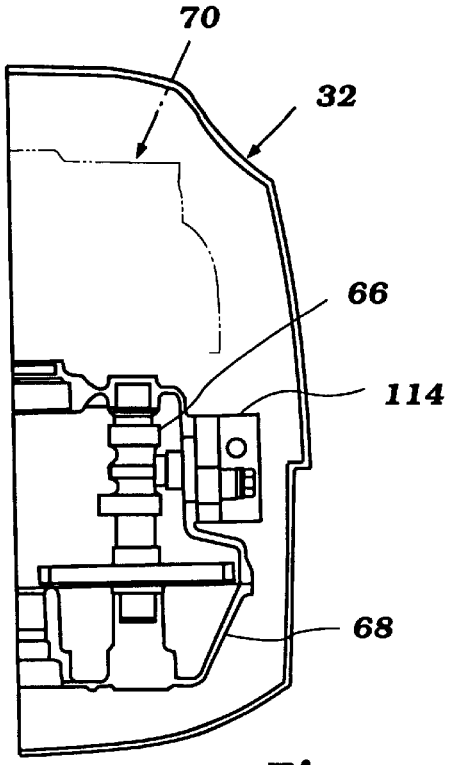
FIG. 8 is a cross-sectional view of the outboard motor power head of FIG. 3 as taken along line D—D.

As best seen in FIG. 8, a camshaft 66 is driven by the crankshaft 28 and operates within the cylinder block 60. A plurality of push rods (not shown) are arranged between the rocker arms and the cam lobes of the camshaft 66 to actuate the rocker arms and the corresponding intake and exhaust valves. Because the invention deals primarily with the engine layout and cowling construction, it is not believed necessary to describe in greater detail the particular valve system and valve operation mechanism of the engine 26.

The engine desirably includes a lubrication system. In the illustrated embodiment, an oil pan 68 (FIG. 8) is located on a lower side of the engine 26. The oil pan 68 desirably communicates with the crankcase to receive a flow of oil (or other lubricant) from the crankcase. An oil pump (not shown) delivers oil (or other lubricant) through the oil galleries in the cylinder block and head 60, 62, and eventually back to the crankcase, so as to lubricate the crankshaft 28, the camshafts 66, the valves and the balance of the valve operating mechanism.

An exhaust system discharges exhaust gases from an exhaust manifold of the engine 26. The exhaust manifold of the engine desirably communicates with an exhaust conduit formed within an exhaust guide (not shown) positioned at an upper end of the drive shaft housing 38. The exhaust conduit of the exhaust guide is connected to an exhaust pipe (not shown) that depends downward into the drive shaft housing 38. The exhaust pipe terminates in an expansion (not shown) chamber formed within the drive shaft housing 38. The expansion chamber in turn communicates with a discharged conduit (not shown) that is formed within the drive shaft housing 38 and with the lower unit 40 and that communicates with a discharge passage formed within the propulsion device 42. In this manner, exhaust gases from the engine 26 are discharged through the hub of the propeller into a region of reduced pressure behind the propulsion device 42, as known in the art. Alternatively, the exhaust gases can be expelled from either the expansion chamber or the exhaust pipe through other discharge outlets.

As shown in FIG. 2 and 3, the engine 26 is provided with a recoil starter 70 so as to permit starting of the motor by rotating the crankshaft 28. A starter knob 72 is connected to a rope (not shown) of the recoil starter 70. The starter 70 is located on an upper side of the engine 26 generally above the crankcase.

A flywheel magneto assembly, indicated generally by reference numeral 74, is affixed in a suitable manner to the exposed upper end of the crankshaft 28. The flywheel magneto 74 includes a hub portion (not shown) which is affixed to the crankshaft 28. A flywheel is affixed to the hub portion and includes a depending flange (not shown) that provides a generally cup shape and which carries permanent magnets for the ignition system of the engine (not shown). In addition, the flywheel magneto 74 may also include a generating system of any know type. A ring gear (not shown) is affixed to the cup shaped portion and specifically to its outer periphery so as to cooperate with the starter mechanism. A cover 76 desirably overlies the flywheel magneto assembly 74, as well as the starter device 70, on the top end of the engine 26.

As best seen in FIGS. 2 and 4, the engine 26 also includes an induction system, generally designated by reference numeral 78, to provide a fuel/air charge to the cylinder(s) of the engine 26. The induction system includes at least one charge former to introduce fuel into intake air before combustion. In the illustrated embodiment, the charge former is a carburetor 80. It should be understood, however, although the present engine layout can be used in conjunction with other types of charge formers, such as fuel injectors or the like.

Figure 5:
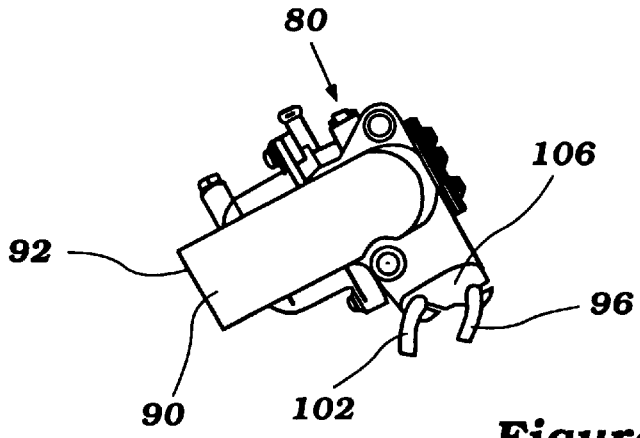
FIG. 5 is view of a carburetor of the engine of FIG. 3 as seen in direction of Arrow A.
Figure 6:
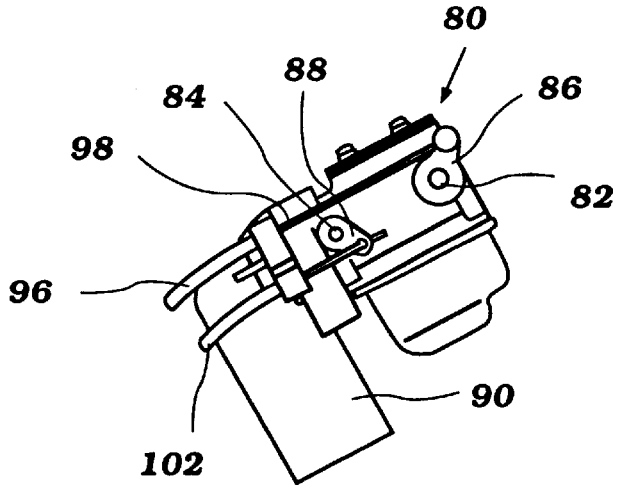
FIG. 6 is a view of the carburetor of FIG. 3 as seen in the direction of Arrow B.

The carburetor 80 can be of any known type of construction. In the illustrated embodiment, as best seen in FIGS. 5 and 6, the carburetor 80 includes a throttle valve (not shown) operated by a throttle shaft 82, and a choke valve (not shown) operated by a choke shaft 84. A throttle lever 86 is connected to the end of an throttle shaft 82, and a choke lever 88 is connected to an end of the choke shaft 84. The carburetor also includes a throat section in which a venturi resides. The throat section defines a flow axis of the air through at least this section of the carburetor 80.

Figure 9:
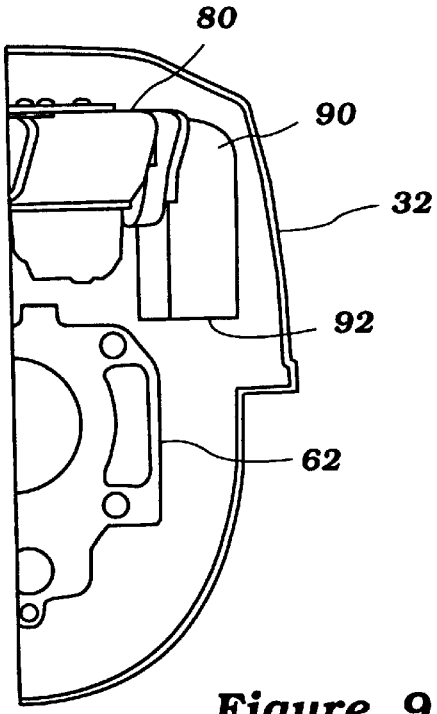
FIG. 9 is a cross-sectional view of the outboard motor power head of FIG. 3 as taken along line E—E.

An air intake device 90 supplies air to the carburetor 80. In the illustrated embodiment, as best seen in FIG. 9, the air intake device has generally an inverted L-shape and include an air intake silencer 79 (FIG. 4). One end of the intake silencer 79 is attached to an inlet end of the carburetor 80. The intake device 90 extends from this point across the top end of the engine body, through a generally ninety-degree bend, and downward. An air intake opening 92 is formed at the lower end of the intake device 90 and faces downward toward the lower tray 34.

An intake pipe 94 (FIG. 2) connects the carburetor 80 to the cylinder head. In the illustrated embodiment, the intake pipe 94 is connected to the cylinder head 62 on a side of the cylinder axis opposite that on which the intake air inlet 92 is located. The induction system 78 thus crosses over a generally vertical plane that contains the axis of the cylinder.

As best seen in FIG. 2, the intake pipe 94 extends from an outlet or downstream side of the carburetor 80 in a direction generally parallel to the top end of the cylinder block 60 beyond a side edge of the engine 28, and then loops back toward the cylinder head 62. The intake pipe 94 thus assumes a generally U-like shape (when turned on its side) as it extends between the carburetor 80 and the cylinder head 62. The outlet mouth of the intake pipe 94 communicates with an intake passage within the cylinder head 62.

The induction system 78 is arranged on the engine 26 so as to reduce the width of the engine 26. For this purpose, the charge former (e.g., the carburetor 80) of the induction system is arranged on top of the cylinder head 62 (and possible overlies a portion of the cylinder block 60 as well), to the rear side of the starter device 70. In the illustrated embodiment, the carburetor 80 lies behind the flywheel magneto cover 76.

In addition, at least one section of the induction system 78, which defines an air passage into which fuel is introduced by the charge former, is arranged on the engine 26 such that a flow axis of the passage is skewed relative to the axis of the cylinder, as well as relative to an interface between the cylinder block 60 and the cylinder head 62. In the illustrated embodiment, the carburetor defines this section of the induction system 78. The flow axis of the carburetor 80 is skewed relative to the axis of the cylinder, so as to reduce further the width of the engine 26.

In addition or in the alternative to the above-described arrangement of the charge former on the engine 26, the intake pipe 94 and the intake device 90 also can be arranged so as to reduce the girth of the engine 26. In the illustrated embodiment, the position of the air inlet opening 92 lies forward of, or closer to a front end of the engine 26 than does a point at which the intake pipe 94 attaches to the cylinder block 62. As a result, the intake device 90 and the intake pipe 94 project outward beyond the sides of the cylinder head and block 62, 60 to a lesser amount than if the carburetor 80 and these components 90, 94 were arranged straight across the engine 26 (i.e., parallel to the intersection plane between the cylinder head 62 and cylinder block 60). This arrangement of the induction system 78 on the engine thus minimizes the size of the engine 26, and consequently the size of the cowling 32 to ease handling of the portable motor 20, as well as performance by reducing aerodynamic draw.

Figure 7:
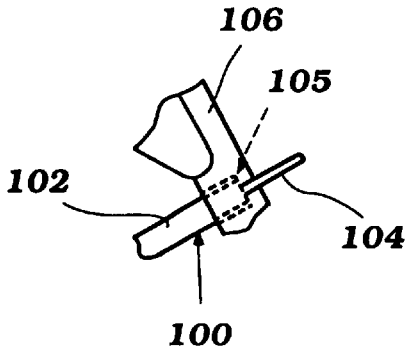
FIG. 7 is an isolated view of a portion of the bracket on the carburetor as seen in the direction of Arrow C of FIG. 3.

As best seen in FIGS. 3, 6 and 7, the throttle control cable 58 actuates the throttle valve of the carburetor 80. In the illustrated embodiment, the cable 58 includes an outer tubular casing 96 and an inner cable wire 98 that slides within the outer casing 96. An end of the cable wire 98 is exposed from the casing 96 and is rotatably connected to the throttle lever 86 in a known manner.

Similarly, a choke control cable 100 actuates the choke valve of the carburetor 80. The cable includes an outer tubular casing 102 and an inner cable wire 104 that slides within the outer casing 102. An end of the cable wire 104 is exposed from the casing 102 and is rotatably connected to the choke lever 88 in a known manner. The other end of the choke control cable is attached to a choke knob 103 that is located on a front side of the cowling 32, as seen in FIG. 3.

As best seen in FIG. 7, a bracket 106 supports the ends 105 of the cable casings 96, 102 at location near the choke and throttle levers 86. 88. In the illustrated embodiment, the bracket 106 is attached to the carburetor body. The bracket 106 includes a through slot and a counterbore for each control cable 58, 100. The through slot receives the cable wire 98, 104 from a side of the bracket 106 with the wire 98, 104 passing through the bracket 106. The end 105 of the cable casing 96, 102, however, is captured and fixed within the counterbore associated with the slot. Fixation can be accomplished in any of a wide variety of ways known to those skilled in the art, such as, for example, but without limitation, an interference fit or an adhesive. The bracket 106 in this manner supports the cables 58, 100 at a point near their connection to the respective valve levers 86, 88.

A fuel supply system supplies fuel to the charge former of the induction system 78. In the illustrated embodiment, the fuel system includes a fuel tank 108 positioned within the cowling 32. As best seen in FIG. 2, the fuel tank 108 lies near the front side of the power head 24. A filler hose 110 extends upward through the cowling on an upper front side of the outboard motor 20 and is capped by a screw cap 112. In this manner, the fuel tank 108 can be filled without removing the upper cowling 36.

A fuel pump 114 (FIG. 8) draws fuel from the fuel tank 108 and delivers it to a fuel bowl of the carburetor 80. In the illustrated embodiment, the fuel pump 114 is mechanically operated and is driven by the camshaft 66. As best understood from FIG. 8, a cam lobe on the camshaft 66 actuates a plunger to pump fuel from the tank 108 to the carburetor 80. A conventional float device (not shown) within the carburetor 80 regulates the level of fuel within the carburetor bowl in a manner well known to those skilled in the art.

Figure 10:
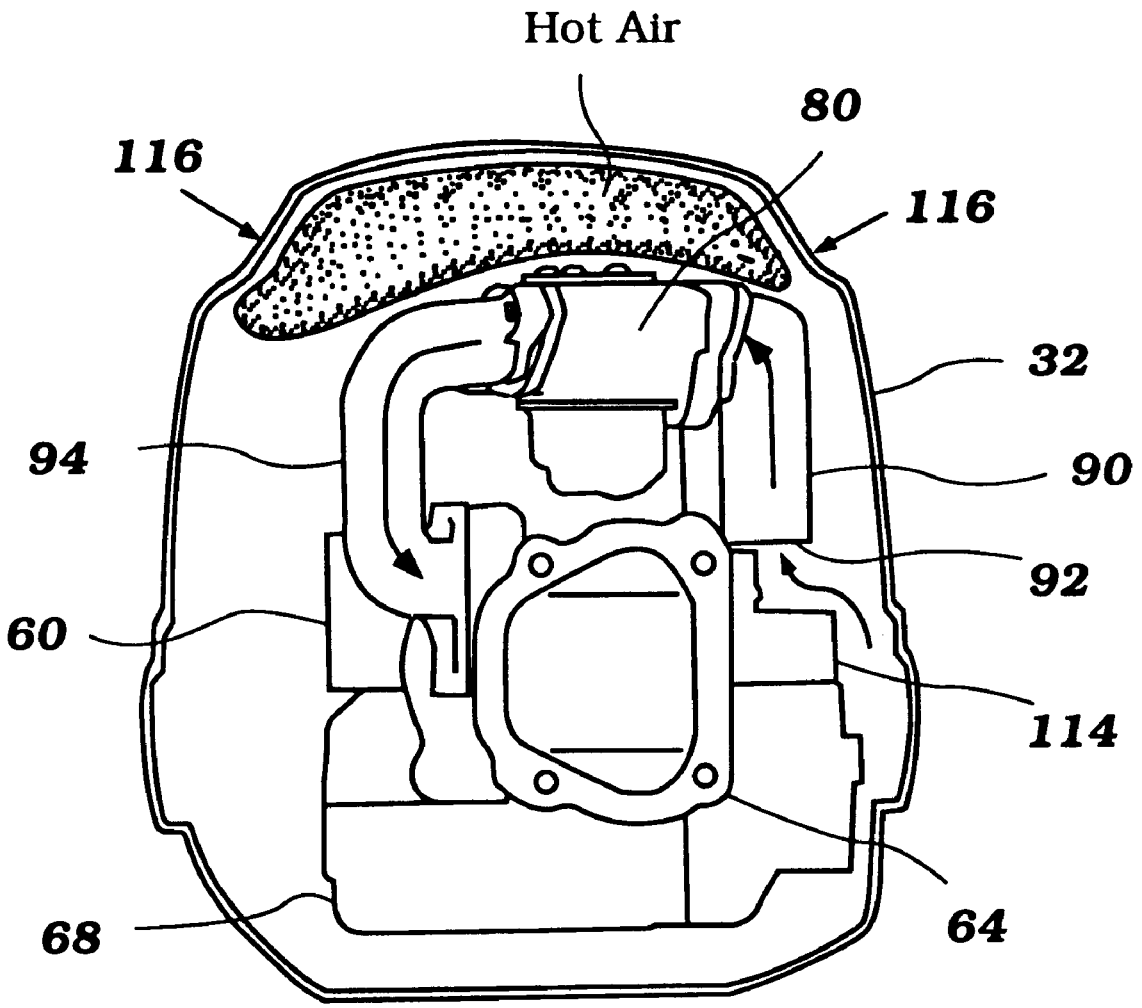
FIG. 10 is a cross-sectional front view of the power head of the outboard motor of FIG. 1 and illustrates the cowling structure about an upper end of the engine.

With engine operation, the air within the cowling elevates in temperature and tends to rise with hot air collecting toward an upper end of the cowling 32, as schematically represented in FIG. 10. Hot air about the carburetor 80—which in accordance with present engine layout lies above the cylinder head—can detrimentally impact the performance of the engine by heating and vaporizing the fuel within the carburetor. This affects the fuel/air ratio of the charge delivered to the engine 26, thereby degrading the engine's performance.

The upper cowling, as seen in FIG. 10, thus desirably includes at least one air vent 116 formed in the cowling to allow hot air to escape from the cowling 38. In the illustrated embodiment, at least two vents holes are formed on the upper sides of the upper cowling 36 on either side of and above the carburetor 80.

FIGS. 11 through 16 illustrate another embodiment of the upper cowling member which includes a top vent to cool a top-mounted carburetor. The above-description should apply equally to features common to both embodiments unless otherwise noted. For this reasons, like components between the embodiments have been designated using the same reference numerals.

The upper vent 116 (FIG. 13) is formed by a hole within an upper section of the upper cowling member 36. In the illustrated embodiment, the vent 116 lies generally above and slightly forward of the carburetor 80 on the rear side of the cowling 32. A generally horizontal section of the cowling is formed by a recessed section 118 of the upper cowling 36 at its aft end. An upstanding rim 120 extends about the opening to prevent an influx of water into the cowling 32 through the vent 116.

Figure 11:
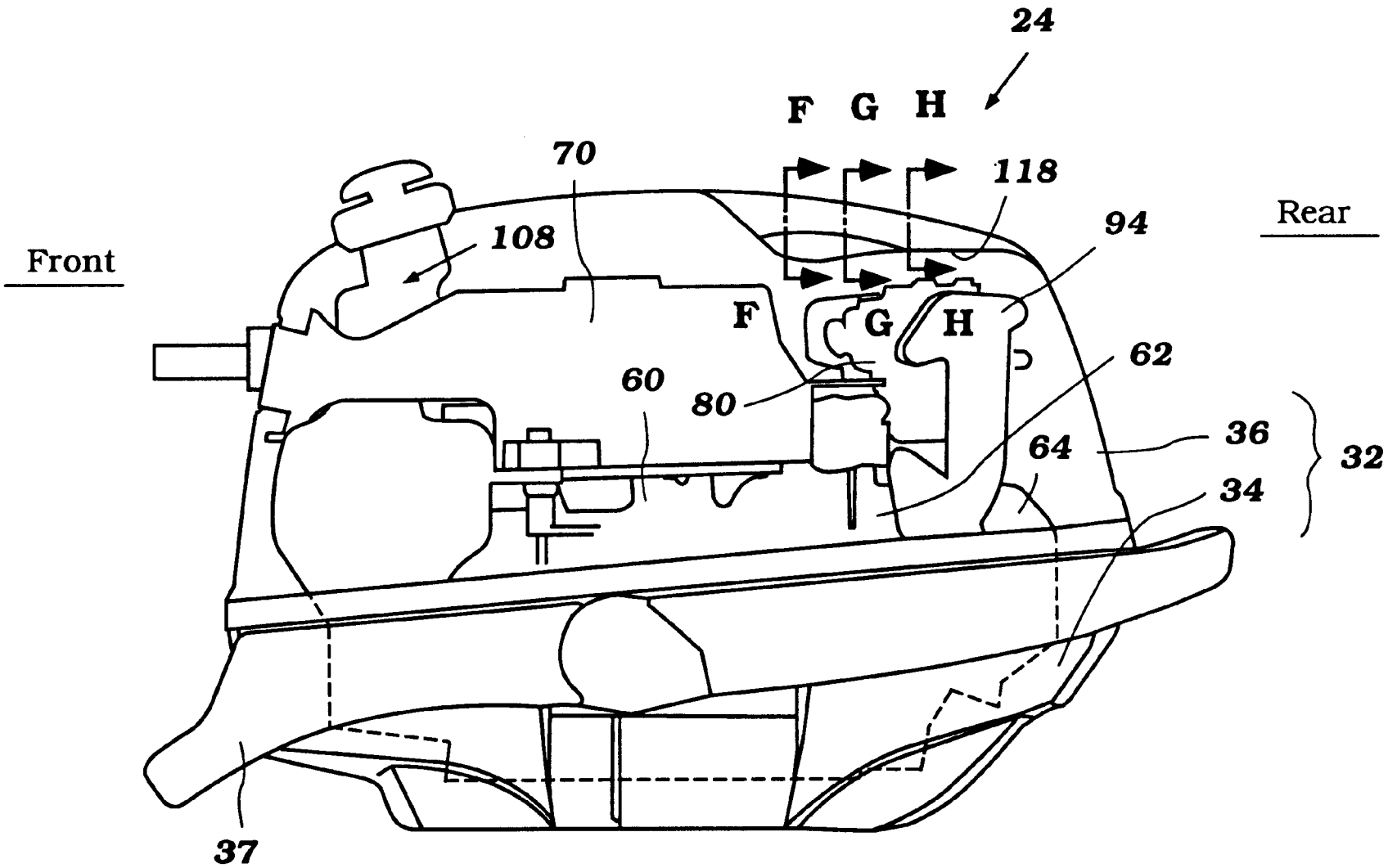
FIG. 11 is a partial section side view of an outboard motor power head and illustrates another cowling design for use with the engine illustrated in FIGS. 1–10.

The cowling 32 desirably includes a cover 122 also for the purpose of inhibiting water invasion. The cover 122 desirably is shaped to fit within the recessed section 118 of the upper cowling member 36 so as to present a generally smooth outer to the cowling 32, as best seen in FIG. 11. The cover 122 is suspended above an upper end of the rim 120 such that a gap T exists between the rim 120 and the cover 122. The sides of the cover 122 also lie above the recessed section 118 such that air gaps S are also formed on the sides of the cowling 32. As understood from FIGS. 12 through 14, these gaps S decrease in size from front to back and are closed at the aft end of the cover 122.

Figure 12:
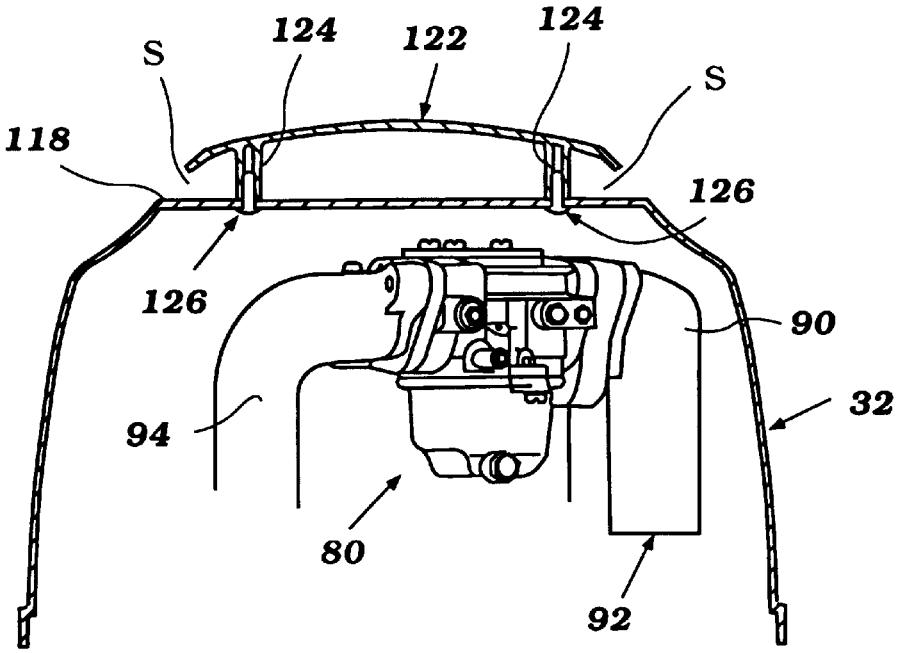
FIG. 12 is a partial cross-sectional view of cowling of FIG. 11 as taken along F—F and illustrates the position of the engine carburetor and associated induction system apart from the engine.
Figure 13:
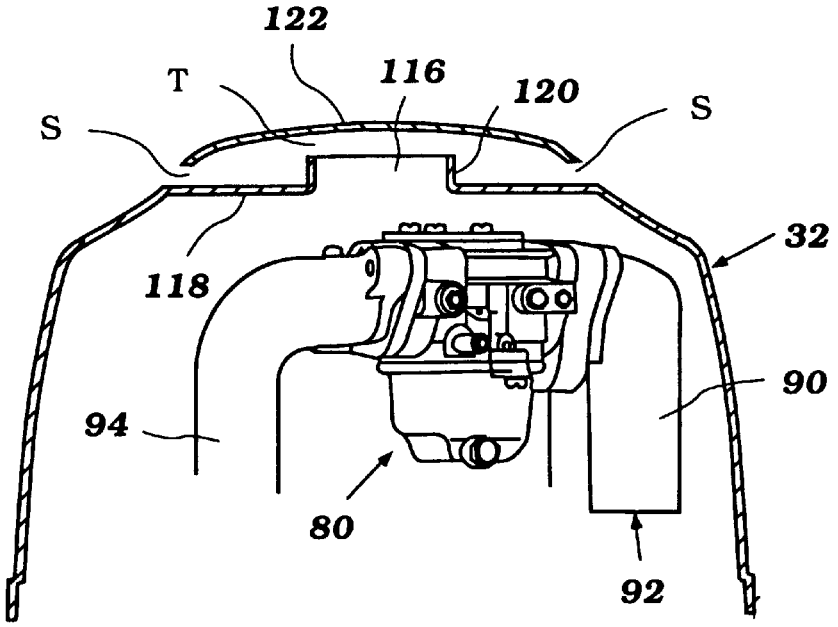
FIG. 13 is a partial cross-sectional view of cowling of FIG. 11 as taken along G—G and illustrates the position of the engine carburetor and associated induction system apart from the engine.

A plurality of legs 124 support the cover 122 above the recessed section 118 of the upper cowling member 36 (FIGS. 12 and 13). In the illustrated embodiment, three legs 124 that are arranged in a triangular pattern support the cover 122. Two legs 124 are positioned toward a fore end of the recessed section 118, while a third leg 124 is positioned toward an aft end of the recessed section 118. The legs 124 are positioned about the opening 118 on the front and rear sides of the opening 116. Fasteners 126 (e.g., screws, rivets, etc.) secure the legs 124 to the recessed section 118.

Figure 14:
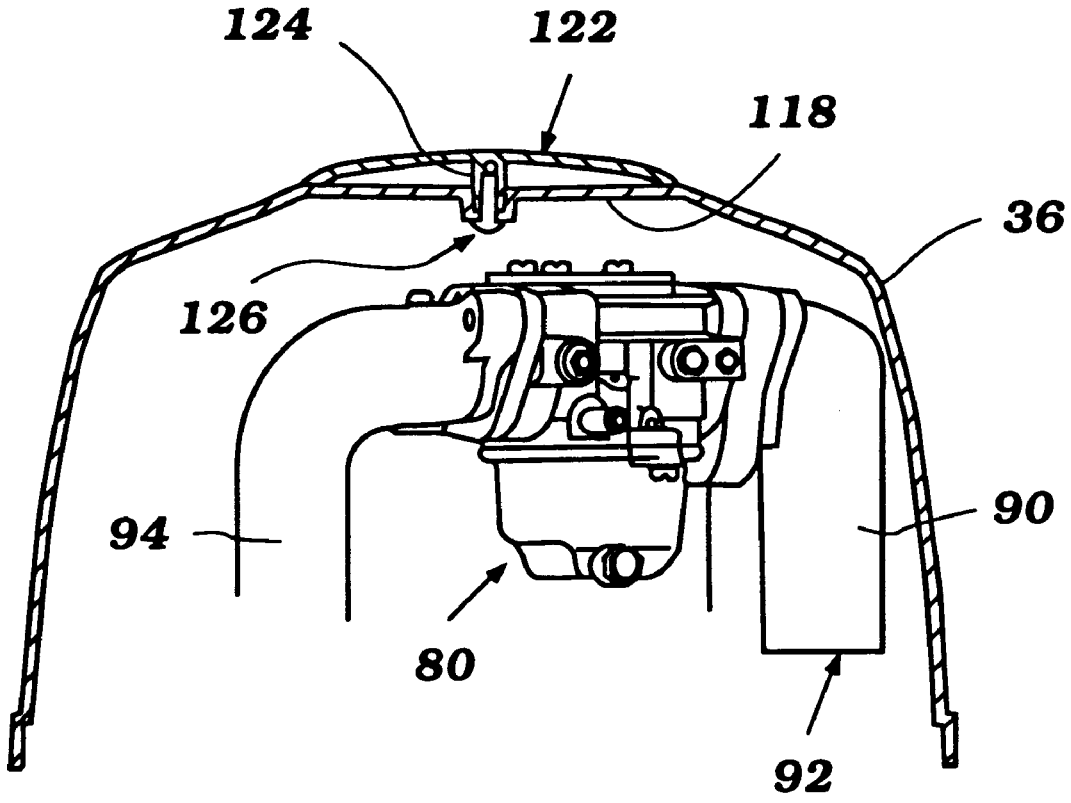
FIG. 14 is a partial cross-sectional view of cowling of FIG. 11 as taken along H—H and illustrates the position of the engine carburetor and associated induction system apart from the engine.

The legs 124 on the front side of the cover 122 are taller than the leg 124 on the aft end of the cover 122. This gives the cover 122 a gradually sloping orientation that blends with the contour of the upper surface of the top cowling member 36, as seen in FIG. 11. And as best seen in FIG. 14, the aft end of the cover 122 rests atop the recessed section 118 so as to close the aft end of the gap S between the cover 122 and the recessed section 118. Water thus does not enter the space between the cover 122 and the recessed section 118 from the aft end of the outboard motor 20 when the associated watercraft is suddenly decelerated.

Figure 15:
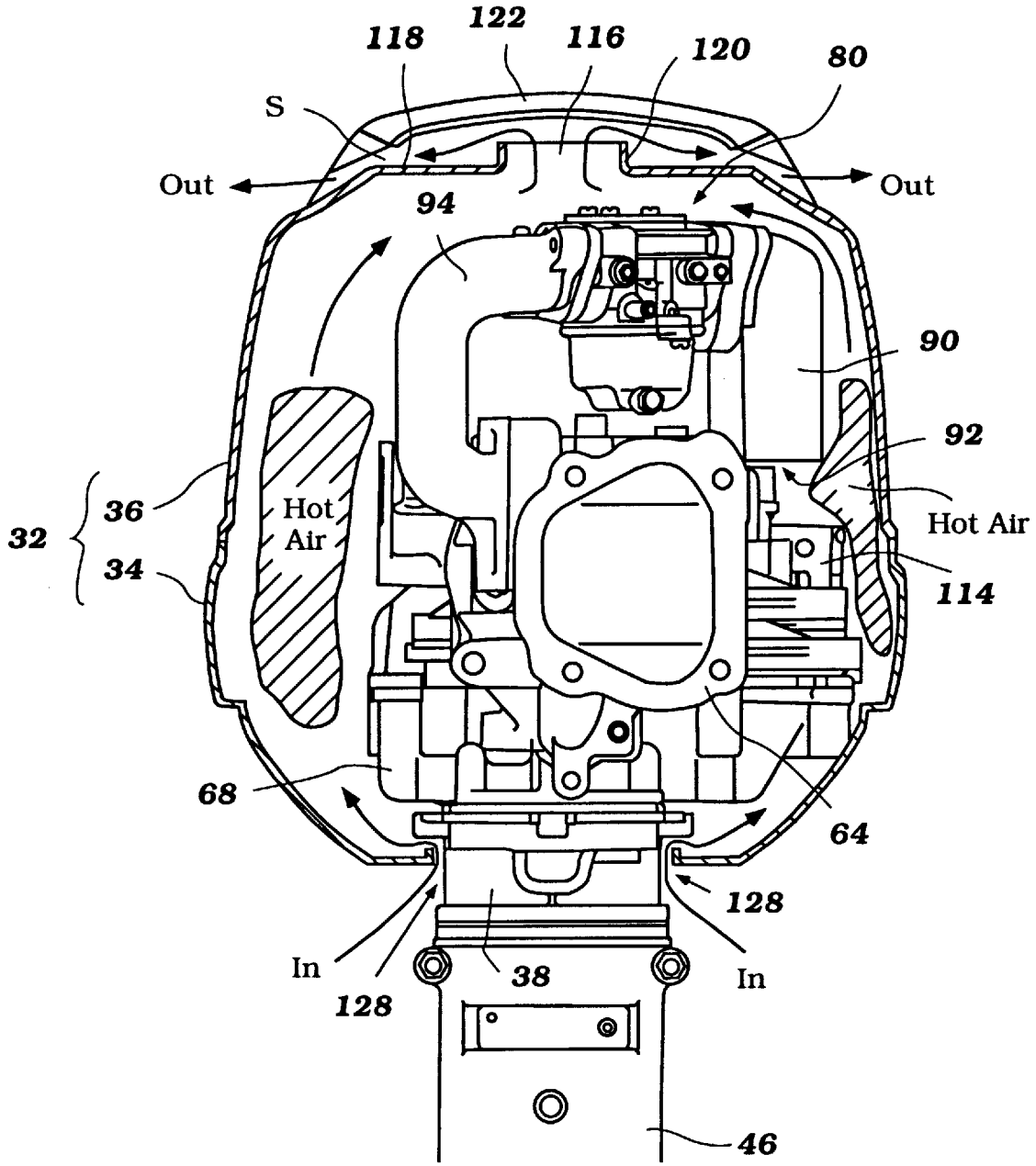
FIG. 15 is a cross-sectional view of the outboard motor power head of FIG. 11 and schematically illustrates the air flow through the cowling for cooling purposes.

As best seen in FIG. 15, the cowling 32 also desirably includes at least a second air vent formed on a lower side of the cowling. In the illustrated embodiment, the second vent 128 is formed between a lower inner edge of the cowling lower tray and the drive shaft housing 38. This lower vent desirably is formed on both the port and starboard sides of the engine 26, and can possibly extend about the drive shaft housing 38 provided that supports are provided to couple the lower tray 34 to either the drive shaft housing 38 or to the swivel bracket 46. In this position, the second vent 128 lies on the lower side of and generally below the engine 26. The position of the vent 128 desirably lies beneath at least a portion of the oil pan 68 for cooling purposes, as described below.

FIG. 15 illustrates the flow of air through the illustrated cowling 32. Air enters the cowling from below through the second air vent 128. The flow of air then flows over the sides of the engine 26 and entrains at least a portion of the air heated by the engine 26. The current of air then flow over the induction system 78 and out the upper first vent 116. The air escapes through the side gaps S between the upper cowling 36 and the cover 122 to expel the hot air from the cowling. When the outboard motor 20 is running at elevated speeds, the inherent pressure differential occurring between the air regions below and above the cowling 32 promote this circulation of air through the cowling. And when running at low speeds, the natural rise of the hot air also draws air through the cowling 32. In addition, as schematically represented in FIG. 1, the shape of the upper opening 116 and the associated cover 122 promote air flow into and out of the top vent 116. This flow of air consequently cools the components of the engine, including the oil pan 68, the fuel pump 114, and the carburetor 80.

Figure 16:
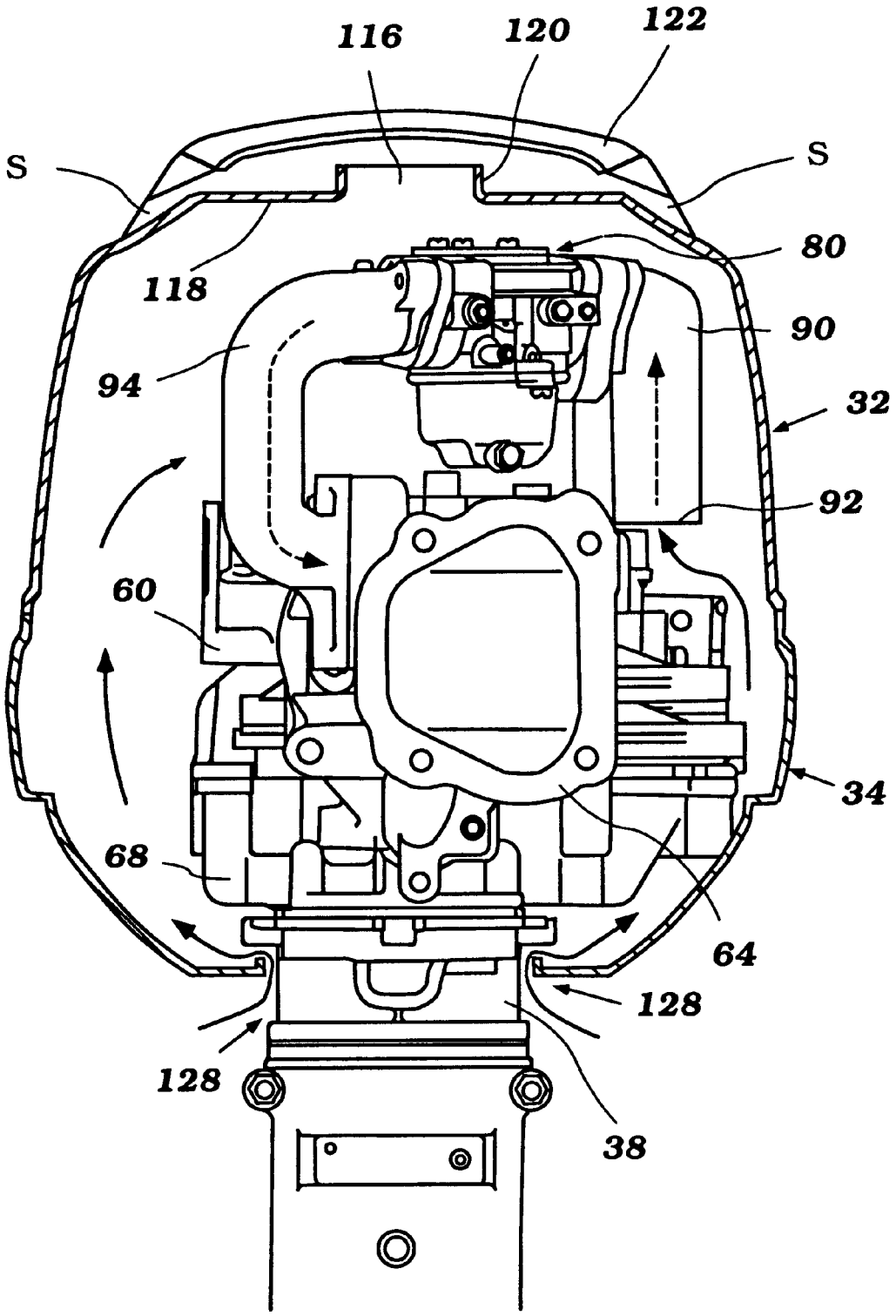
FIG. 16 is a cross-sectional view of the outboard motor power head of FIG. 11 and schematically illustrates the air flow through the cowling and the engine induction system for engine operation.

The operation of the engine 26 also promotes a flow of air through the cowling 26, as schematically illustrated in FIG. 16. The air drawn into the cowling 32 through the lower vent 128 is directed upward toward the downward facing air inlet opening 92 of the induction system 78. To get to the induction system inlet 92, however, the air must pass through the labyrinth formed at the lower end of the cowling between the lower tray and the drive shaft housing. This labyrinth path tends to cause water droplets, that are carried by the air stream, to drop out of the of the air flow and drain back through the lower vent 128. The flow of air into the induction 78 system, however, is not further restricted so as to provide amble air for engine operation. In addition, the downward facing orientation of the air inlet opening 92 tends to draw in cooler air from the lower vent 128 to improve engine performance.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. An outboard motor comprising an engine which drives a propulsion device, the engine including a cylinder block and a cylinder head attached to the cylinder block, a crankshaft journalled to rotate within a crankcase formed on an opposite end of the cylinder block from the cylinder head, a starter device coupled to the crankshaft and positioned on an upper side of the engine generally above the crankcase, and an induction system including a carburetor being arranged generally over the cylinder head and to the side of the starter device.

2. An outboard motor as in claim 1, wherein the cylinder head and cylinder block together define at least one cylinder having an axis, the carburetor includes a throat having a flow axis, and the carburetor is arranged on the engine such that the flow axis of the carburetor throat lies skewed relative to the axis of the cylinder.

3. An outboard motor as in claim 1, wherein the induction system includes an air intake device communicating with at least the carburetor, and the air intake device includes a downward facing air inlet.

4. An outboard motor as in claim 3, wherein the air intake device extends downward.

5. An outboard motor as in claim 1, wherein the induction system includes at least one intake pipe connected to the carburetor and to the cylinder head, and the intake pipe has a generally u-shape as defined between the carburetor and the cylinder head.

6. An outboard motor as in claim 1 additionally comprising a cowling that surrounds and at least substantially encloses the engine, said cowling including at least one vent located generally above the carburetor.

7. An outboard motor as in claim 6, wherein the vent is formed on an upper section of the cowling and a cover is attached to the upper section in a position lying above and spaced from the vent.

8. An outboard motor as in claim 7, wherein the vent includes a generally upstanding rim that extends about an opening formed in the upper section of the cowling.

9. An outboard motor as in claim 6, wherein the cowling additionally comprises a second vent that is located near a lower end of the cowling, whereby cool air is drawn into the cowling throught the second vent while warm air is expelled through the vent above the carburetor.

10. An outboard motor as in claim 9, wherein the second vent is defined between a lower tray of the cowling and a drive shaft housing of the outboard motor.

11. An outboard motor as in claim 10, wherein at least a portion of the second vent is located beneath the engine.

12. An outboard motor as in claim 1 additionally comprising at least one throttle control cable coupled to at least one throttle valve of the carburetor via an actuator mechanism, the control cable comprising an outer tubular casing and an inner cable wire that slides within the outer casing, and a fixture attached to the carburetor and arranged to secure an end of the outer casing at a location near the connection between the inner cable wire and the actuator mechanism.

13. An outboard motor as in claim 1 additionally comprising at least one choke control cable coupled to at least one choke valve of the carburetor via an actuator mechanism, the choke control cable comprising an outer tubular casing and an inner cable wire that slides within the outer casing, and a fixture attached to the carburetor and arranged to secure an end of the outer casing at a location near the connection between the inner cable wire and the actuator mechanism.

14. An outboard motor as in claim 1, wherein the induction system additionally comprises an intake device communicating with the carburetor at an inlet thereof and including an air inlet, and an intake pipe extending between the carburetor and the cylinder head, and the intake device is arranged on the engine such that the air inlet lies closer to a forward end of the engine than does a point at which the intake pipe is attached to the cylinder head.

15. An outboard motor comprising an engine which drives a propulsion device, the engine including a cylinder block and a cylinder head attached to the cylinder block, the cylinder block and the cylinder head together defining at least one cylinder having an axis, and an induction system comprising an air inlet and an air outlet communicating with the cylinder, the air inlet being located on one side of the cylinder axis and the air outlet being located on the opposite side of the cylinder axis.

16. An outboard motor as in claim 15, wherein the induction system is arranged on the engine such that the air inlet lies closer to a forward end of the engine than does the outlet.

17. An outboard motor as in claim 15, wherein the induction system includes at least one charge former positioned between the air inlet and the outlet.

18. An outboard motor as in claim 17, wherein the charge former is a carburetor that is positioned above the cylinder head.

19. An outboard motor as in claim 17, wherein a section of the induction system defines an air passage into which the charge former introduces fuel, and the air flow passage has a flow axis that is skewed relative to the axis of the cylinder.

20. An outboard motor as in claim 15, wherein the induction system includes an air intake device having a downward facing air inlet.

21. An outboard motor as in claim 15, wherein the induction system includes at least one intake pipe connected to the cylinder head, said intake pipe extending from a point generally above the cylinder head, about the side of the cylinder head, and to a point on the side of the cylinder head in a generally U-shape manner.

22. An outboard motor comprising an engine which drives a propulsion device, the engine including a cylinder block and a cylinder head attached to the cylinder block, the cylinder block and the cylinder head together defining at least one cylinder having an axis, and an induction system comprising at least one air inlet and at least one air outlet communicating with the cylinder, at least a section of the induction system between the air inlet and air outlet crossing over a generally vertical plane that contains the axis of the cylinder.

23. An outboard motor as in claim 22, wherein the induction system includes at least one charge former positioned between the air inlet and the outlet.

24. An outboard motor as in claim 23, wherein the charge former is a carburetor that is positioned above the cylinder head.

25. An outboard motor as in claim 23, wherein a section of the induction system defines an air passage into which the charge former introduces fuel, and the air flow passage has a flow axis that is skewed relative to the axis of the cylinder.

26. An outboard motor as in claim 22, wherein the induction system includes an air intake device having a downward facing air inlet.

27. An outboard motor as in claim 22, wherein the induction system is arranged on the engine such that the air inlet lies closer to a forward end of the engine than does the outlet.

28. An outboard motor comprising an engine which drives a propulsion device and a cowling that surrounds and substantially encloses the engine, the engine including an induction system comprising at least one charge former arranged on an upper side of the engine, and the cowling includes at least first and second vents, the first vent being located generally above the charge former and the second vent being located near a lower end of the cowling, whereby cool air is drawn into the cowling through the second vent while warm air is expelled through the first vent.

29. An outboard motor as in claim 28, wherein the charge former comprises a carburetor.

30. An outboard motor as in claim 28, wherein the induction system includes an air intake device having an air inlet facing toward the second vent.

31. An outboard motor as in claim 28, wherein the second vent is defined between a lower tray of the cowling and an upper drive shaft housing of the outboard motor.

32. An outboard motor as in claim 28, wherein at least a portion of the second vent is located below the engine.

33. An outboard motor as in claim 32, wherein at least a portion of the second vent is located beneath an oil pan of the engine.

34. An outboard motor as in claim 28, wherein the first vent is formed on an upper section of the cowling and a cover is attached to the upper section in a position lying above and spaced from the first vent.

35. An outboard motor as in claim 34, wherein the first vent includes a generally upstanding rim that extends about an opening formed in the upper section of the cowling.

36. An outboard motor comprising an engine which drives a propulsion device, the engine including a cylinder block and a cylinder head attached to the cylinder block, the cylinder head and cylinder block together defining at least one cylinder about a first axis, a crankshaft journalled to rotate within a crankcase formed on an opposite end of the cylinder block from the cylinder head, the crankshaft defining a second axis, the first axis and second axis together defining a first plane, and an induction system including a carburetor, the carburetor having a throat that defines a flow axis that lies oblique to the first plane.

37. An outboard motor as in claim 36, wherein the flow axis also lies parallel to a second plane that lies perpendicular to the first plane and also contains the first axis.

38. An outboard motor as in claim 36, wherein the carburetor is arranged generally over the cylinder head and the side of a starter device.

* * * * *